US008407867B2

(12) United States Patent
Conti

(10) Patent No.: US 8,407,867 B2
(45) Date of Patent: Apr. 2, 2013

(54) CLAMP FOR AN ELONGATED LAMP

(75) Inventor: Chris Conti, North Bergen, NJ (US)

(73) Assignee: Production Resource Group, L.L.C., New Windsor, NY (US)

( * ) Notice: Subject to any disclaimer, the term of this patent is extended or adjusted under 35 U.S.C. 154(b) by 0 days.

(21) Appl. No.: 13/523,225

(22) Filed: Jun. 14, 2012

(65) Prior Publication Data

US 2012/0260471 A1 Oct. 18, 2012

Related U.S. Application Data

(63) Continuation of application No. 12/022,816, filed on Jan. 30, 2008, now abandoned.

(60) Provisional application No. 60/888,510, filed on Feb. 6, 2007.

(51) Int. Cl.
*F21S 4/00* (2006.01)
*F21V 21/00* (2006.01)

(52) U.S. Cl. ..... 24/458; 24/456; 24/486; 24/487; 24/489; 24/498; 24/499; 362/326; 362/217.1; 16/238; 16/245; 16/252; 206/467; 206/470; 206/487

(58) Field of Classification Search ..... 24/456, 24/458, 486, 487, 489, 498, 499; 362/328, 362/217.1; 16/238, 245, 252; 206/465, 467, 206/470, 487

See application file for complete search history.

(56) References Cited

U.S. PATENT DOCUMENTS

| | | | | |
|---|---|---|---|---|
| 1,301,553 | A | | 4/1919 | Garner |
| 2,304,393 | A | | 12/1942 | Bateman |
| 2,533,661 | A | * | 12/1950 | Arenberg et al. ..... 362/319 |
| 4,505,010 | A | | 3/1985 | Arenhold |
| 4,854,016 | A | | 8/1989 | Rice |
| 5,111,606 | A | * | 5/1992 | Reynolds ..... 40/661.02 |
| 5,272,952 | A | | 12/1993 | Hoshino |
| 5,381,243 | A | * | 1/1995 | Imamura ..... 358/471 |
| 5,471,372 | A | * | 11/1995 | Mamelson et al. ..... 362/92 |
| 5,765,944 | A | | 6/1998 | Fallon et al. |
| 6,202,266 | B1 | | 3/2001 | Van den Branden et al. |
| 6,370,741 | B1 | | 4/2002 | Lu |
| 6,681,971 | B2 | | 1/2004 | Laverack et al. |
| 6,829,854 | B2 | * | 12/2004 | Reynolds ..... 40/642.02 |
| 2002/0000027 | A1 | | 1/2002 | Andersen et al. |

* cited by examiner

*Primary Examiner* — Robert J Sandy
*Assistant Examiner* — David Upchurch
(74) *Attorney, Agent, or Firm* — Law Office of Scott C. Harris, Inc.

(57) ABSTRACT

A clamp for an elongated tube style white such as a versa tube. The clamp has one fixed side that holds the versa tube's mounting structure therein. The other side of the clamp is movable, and pivots between an open position and a closed position. In the closed position, the lamp is held into place, and in the open position the lamp can be removed. A single screw that holds the clamp into the open or closed position is knurled and hence the device can be removed without any tools. The two sides of the clamp occupy different longitudinal positions so that they can be placed directly next to each other, and one opened without moving or disturbing the other since the two sides are in different longitudinal positions.

10 Claims, 4 Drawing Sheets

CLAMP FOR AN ELONGATED LAMP

This application claims priority to provisional application Ser. No. 60/888,510 filed Feb. 6, 2007, the disclosure of which is herewith incorporated by reference.

BACKGROUND

The versa tube lamp is an elongated lamp with a base connection and a top portion. For example, FIG. 1A shows a side view of a versa tube. The base 100 houses lighting elements, for example plural spaced LEDs. The top portion 105 includes a dome that allows viewing the lit LEDs.

The bottom portion of the versa tube lamp includes protruding notches shown respectively as 110, 111 that can be used for mounting the base. The mounting structure, shown in FIG. 1B, includes corresponding notches. Notch 150 holds a corresponding notch 110 on the versa tube 110. The other versa tube notch 111 similarly fits into a notch 151 that is formed on the other side of the clamp. The versa tube can be slid into place, or can be placed in place and then screwed in with a screw portion 155.

The clamp requires tools to assemble. Also, it may be difficult to remove lights when the clamps are placed one right against the other with the long axes parallel to one another.

SUMMARY

Figure 1A:
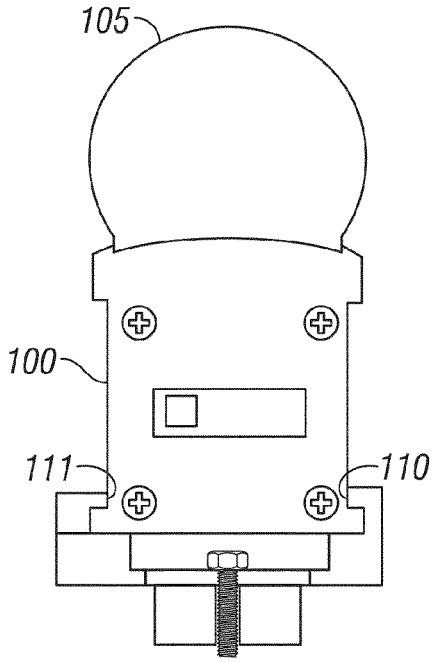
FIG. 1A shows a side view of a prior art tube.
Figure 1B:
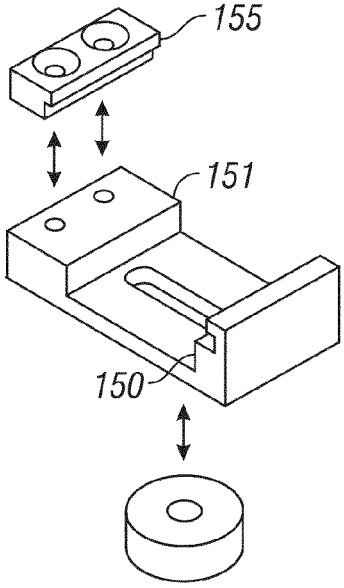
FIG. 1B shows the mounting structure of the prior art tube.
Figure 2:
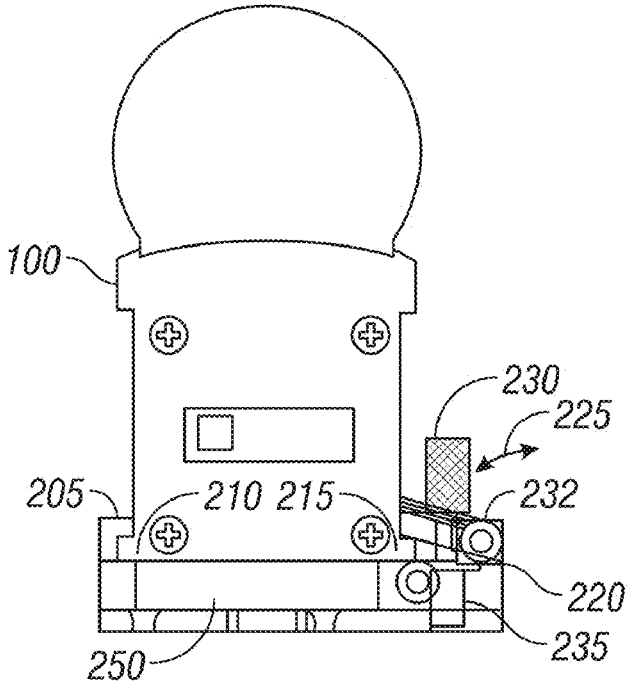
FIG. 2 shows an end view of the tube and the clamping device.

The present application describes a new form of clamp for a versa tube or similarly mechanically configured type of lighting device. FIG. 2 shows an end view of the versa tube and the clamping device of an embodiment. The versa tube may be an elongated device, for example, 1 foot long or longer. The clamping device clamps only a portion of the versa tube, for example, two or more 3 inch areas at different separated locations along the elongated tube.

Figure 3:
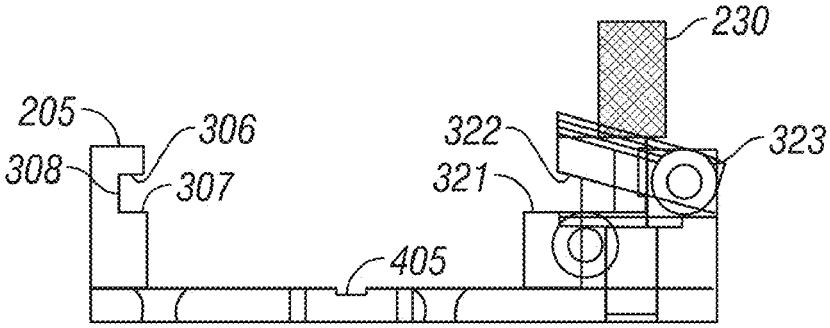
FIG. 3 shows a detailed view of the clamp.

The clamp includes a fixed clamping portion 205 which has an inside surface that presses against the outer edge surface 210, e.g., a mounting notch, on the outside of the tube housing. The notch has first and second holding surfaces 306, 307, which are substantially parallel to one another, and each extend horizontally. An opposite facing surface 308 extends between the first and second surfaces 306, 307. This fixed clamping portion 205 forms an un-movable pocket which is sized to fit a corresponding notch on a held element, here the versa tube. In FIG. 3, the other side which has the thumbscrew 230 includes first and second holding surfaces 321, 322. The first holding surface 321 is unmovable, and at substantially the same a height preferably as the bottom surface 307. The second holding surface 322 is hinged by a hinge 323 relative to the first holding surface. The second holding surface 322 can be pressed downward to hold the tube in place by the other edge surface 215. This forms a hinged clamping portion 220 which is capable of rotating and moving in the direction of the arrow 225. A spring 232, which can be a spiral spring, for example, can bias the hinge into the open position. When in the downward most position, a thumbscrew 230 connects to a screw portion 235 that can be screwed into the clamp body 250. The thumbscrew can be any kind of screw that can be tightened and loosened without tools, e.g., a screw with a roughened or knurled outer surface, or a wing nut, or other kind of tool-less screw. Alternatively, this can use a quick release pin, or a quarter turn screw. A tooled screw can also be used, or the screw can, for example, have a tool assist capability.

When screwed down, the versa tube is effectively held at its two edges via the outer edge clamping portion 210 and the other edge surface 215. However, the versa tube device 100 and can be easily removed without tools by simply loosening thumb screw 230. In addition, the device can be removed by loosening only this one single screw.

FIG. 3 illustrates a more detailed view of only the clamp showing the portions noted above.

Figure 4:
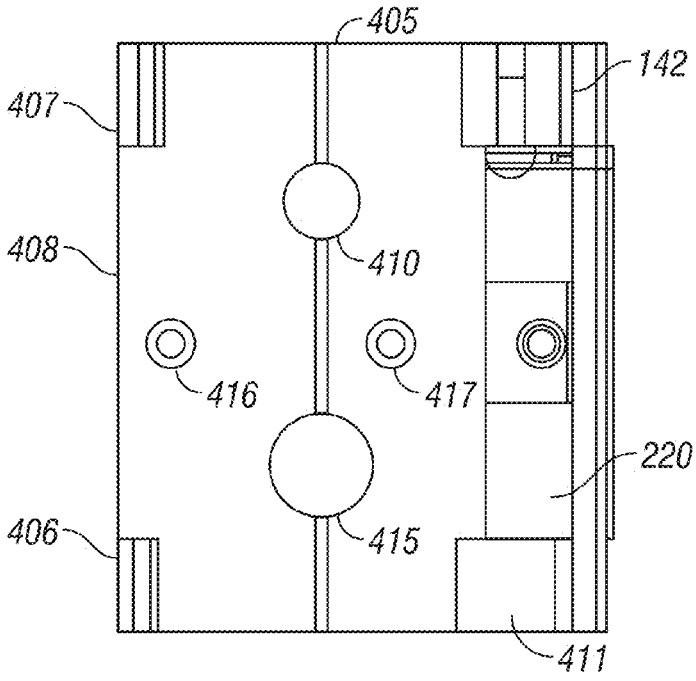
FIG. 4 shows a top view of the clamp.

FIG. 4 shows a top view of the clamp. The clamp includes a machined line 405 which can also be seen in the view of FIG. 3. The line goes down the center of the clamp, and can hence be used for aligning relative to a line on the mounting surface. The clamp also includes a number of holes for screws, including the hole 410, a larger hole 415, as well as holes 416 and 417 which are sized for drywall screws, and which may be beveled on their edges, as shown. The notch 205 is actually formed of two separated holding portions 406, 407 that collectively form a holding portion. A space 408 between the two portions has no such clamp holding portion. The hinged holding portion on the other side 220 is only located in the area longitudinally similar to area 408. There are open areas 411, 412 at areas corresponding to the area of the fixed portions of the clamp. That is, the portions on the two sides of the clamp are longitudinally non-adjacent to one another.

Figure 5:
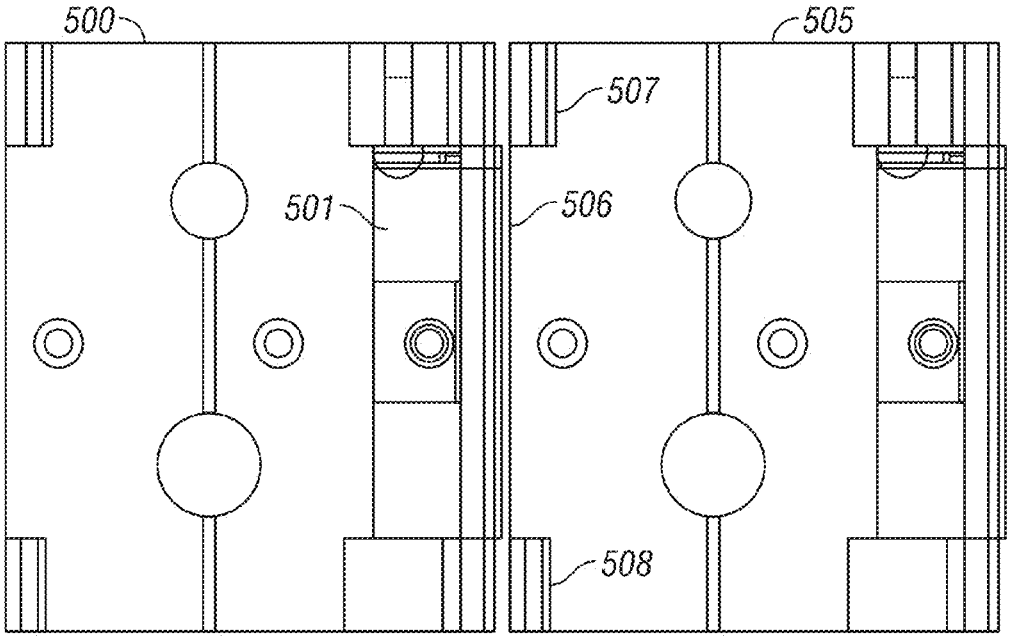
FIG. 5 shows two versa tube clamps.

Because the hinged and fixed portions occupy totally separate longitudinally-adjacent areas, two of the clamp holders can be placed right next to each other while still allowing the devices to be installed and removed. FIG. 5 illustrates two versa tube clamps 500, 505 one right next to the other. The hinge of clamp 500 is shown as opened completely in FIG. 5, since the openable portion 501 of the unit 500 fits into the space 506 between the two fixed flanges 507, 508 of the hinge of the unit 505.

Figure 6:
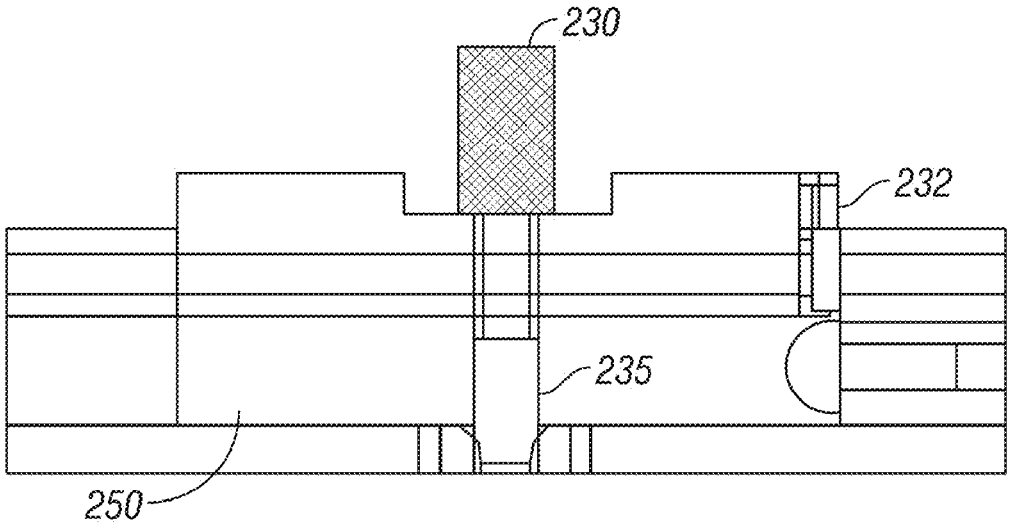
FIG. 6 shows a side view of the clamp.

FIG. 6 illustrates a side view of the clamp, showing the thumbscrew 230 and how it can be screwed into screw portion 235, causing it to press against the top surface of the closing mechanism 200, causing it to close against the force of the torsion spring 232 toward the base 250.

The clamp, as shown, may have an outer dimension of approximately 2½ inches wide (in the direction between the fixed portions of the clamps), and 3 inches long. Any other length may alternatively be used. The other figures show detailed assembly drawings illustrating assembly of the clamp.

Applicant intends that other modifications are included within this device, and intend that other sizes and types of lamps can be used to hold this device.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, while the above uses the embodiment of a 'versaclamp', other elongated lamps can be mounted and monitored in an analogous way.

Also, the inventors intend that only those claims which use the words "means for" are intended to be interpreted under 35 USC 112, sixth paragraph. Moreover, no limitations from the specification are intended to be read into any claims, unless those limitations are expressly included in the claims.

The invention claimed is:

1. A clamp assembly for an elongated tube style lamp, comprising:

a first clamp comprising:

a housing having a bottom portion, and first and second holding ends, said first holding end extending along a first axis and said second holding end extending along a second axis, and where both said first axis and said second axis extend in a direction perpendicular to said bottom portion, and said first and second holding ends forming sidewalls of the housing, said housing having a first holding portion in the first holding end, said first holding portion forming a notch which has at least three surfaces including first and second and third holding surfaces, that forms a fixed pocket which is sized to fit a corresponding first notch on a held lamp element; and said housing also having a second holding portion in the second holding end, said housing located spaced a distance from said first holding portion, said distance defined by said bottom portion, said second holding portion including a fixed bottom portion, and a hinged top portion which hinges on a hinge point that is spaced from and distant from said second holding portion, said top portion hinging on said point between a closed position where said top portion includes a pressing surface holds against a second notch of the held lamp element and hinges to an open position where said pressing surface no longer faces said bottom portion and does not hold said second notch of the held lamp element; and said second housing end including a hinge portion including a fastener that extends along said second axis to tighten and loosen in a way such that a second clamp can be located next to said first clamp, and is tightened to hold said pressing surface against said second notch, and where said second notch cannot be released from said pressing surface without loosening said fastener.

2. A clamp as in claim 1, further comprising a spring, pressing said hinged portion toward open position.

3. A clamp as in claim 2, wherein said fastener comprises a screw with a knurled exterior, capable of being tightened to press the hinged portion into a downward position against a force of said spring.

4. A clamp as in claim 1, wherein said fastener comprises a screw with a knurled exterior, capable of being tightened to press the pressing surface into a downward position against a force of said spring.

5. A clamp as in claim 1, where said fastener moves and is adjustable in a direction that is perpendicular to said bottom portion and is adjusted from above said housing.

6. A clamp as in claim 5, further comprising the second clamp, the second clamp comprising a housing having a bottom portion, and first and second holding surfaces, said first holding surface extending along a first axis and said second holding extending along a second axis, and where both said first axis and said second axis extend in a direction perpendicular to said bottom portion, and said first and second ends forming sidewalls of the housing, said housing having a first holding portion in the first holding surface, said first holding portion forming a notch which has at least three surfaces including first and second and third holding surfaces, that form a fixed pocket which is sized to fit a corresponding first notch on a held lamp element; and said housing also having a second holding portion in the second holding surface, said housing located spaced a distance from said first holding portion, said distance defined by said bottom portion, said second holding portion including a fixed bottom portion, and a hinged top portion which hinges on a hinge point that is spaced from and distant from said second holding portion, said top portion hinging on said point between a closed position where said top portion includes a pressing surface holds against a second notch of the held lamp element and hinges to an open position where said pressing surface no longer faces said bottom portion and does not hold said second notch of the held lamp element; and said second housing end including a hinge portion including a fastener that extends to tighten and loosen in a direction in a direction of said second axis, and is tightened to hold said pressing surface against said second notch, and where said second notch cannot be released from said pressing surface without loosening said fastener, said second clamp being located with said second holding surface of said first clamp right next to said first holding surface of said second clamp.

7. A clamp as in claim 1, further comprising an alignment line, etched along said bottom portion, at a location that enables aligning an object therewith.

8. A tube style lamp assembly, comprising:

a first tube lamp mounted in a first housing, and another tube lamp mounted in another housing, right next to the first tube lamp, the first tube lamp, extending along a light emitting axis, having an upper part with a light emitting along said light emitting axis, and having a bottom part supporting said upper part, said bottom part including first and second extending portions which extend away from said light emitting axis in a first direction perpendicular to said bottom portion and perpendicular to said light emitting axis;

a housing having a first holding portion, forming a notch which has at least three surfaces including first and second holding surfaces, that form a fixed pocket which is sized to fit said first extending portion on said tube lamp; and said housing also having a second holding portion, located spaced a distance from said first holding portion, said second holding portion including a fixed bottom portion, and a hinged portion including a hinged top portion which hinges on a hinge point that is spaced from and distant from said second holding portion, said top portion hinging on said point between a closed position where said top portion includes a pressing surface holds against said second extending portion of the tube lamp and hinges to an open position where said pressing surface no longer faces said bottom portion and does not hold said second extending portion of the held lamp element tube lamp;

said housing having a bottom housing portion, extending between said first holding portion and said second holding portion and said housing including a fastener that is tightened to hold said pressing surface against said second extending portion, and where said second extending portion cannot be released from said pressing surface without loosening said fastener;

the another tube lamp, extending along a light emitting axis, having an upper part with a light emitting along said light emitting axis, and having a bottom part supporting said upper part, said bottom part including first and second extending portions which extend away from said light emitting axis in a first direction perpendicular to said bottom portion and perpendicular to said light emitting axis and another housing having a first holding portion, forming a notch which has at least three surfaces including first and second holding surfaces, that form a fixed pocket which is sized to fit said first extending portion on said another tube lamp; and said another housing also having a second holding portion, located spaced a distance from said first holding portion, said second holding portion including a fixed bottom portion, and a hinged portion including a hinged top portion which hinges on a hinge point that is spaced from and distant from said second holding portion, said top portion hinging on said point between a closed position where said top portion includes a pressing surface holds against said second extending portion of the another tube lamp and hinges to an open position where said pressing surface no longer faces said bottom portion and does not hold said second extending portion of the another tube lamp;

said another housing having a bottom housing portion, extending between said first holding portion and said second holding portion and said another housing including a fastener that is tightened to hold said pressing surface against said second extending portion, and where said second extending portion cannot be released from said pressing surface without loosening said fastener where said fastener moves and is adjustable in a direction that is perpendicular to said bottom portion and is adjusted from above said housing by moving parallel to directions of sidewalls of said housing, when said another housing is next to said housing.

9. A clamp as in claim 8, further comprising a spring, pressing said fastener towards its open position.

10. A clamp as in claim 9, wherein said fastener comprises a screw with a knurled exterior, capable of being tightened to press the second holding portion into a downward position against a force of said spring.

* * * * *